US009074303B2

(12) United States Patent
Masuda et al.

(10) Patent No.: US 9,074,303 B2
(45) Date of Patent: Jul. 7, 2015

(54) FIBERS, NONWOVEN FABRIC AND USES THEREOF

(75) Inventors: Kazuhiko Masuda, Chiba (JP); Yoshihisa Kawakami, Yokkaichi (JP); Hisashi Morimoto, Ichihara (JP)

(73) Assignee: MITSUI CHEMICALS, INC., Tokyo (JP)

( * ) Notice: Subject to any disclaimer, the term of this patent is extended or adjusted under 35 U.S.C. 154(b) by 0 days.

(21) Appl. No.: 13/060,725

(22) PCT Filed: Aug. 18, 2009

(86) PCT No.: PCT/JP2009/064416

§ 371 (c)(1), (2), (4) Date: Feb. 25, 2011

(87) PCT Pub. No.: WO2010/024147

PCT Pub. Date: Mar. 4, 2010

(65) Prior Publication Data

US 2011/0189917 A1 Aug. 4, 2011

(30) Foreign Application Priority Data

Aug. 25, 2008 (JP) ..... 2008-215743
Dec. 11, 2008 (JP) ..... 2008-316092

(51) Int. Cl.

| | |
|---|---|
| ***D04H 3/007*** | (2012.01) |
| ***D04H 1/541*** | (2012.01) |
| ***B32B 27/02*** | (2006.01) |
| ***A61F 13/49*** | (2006.01) |
| ***D01F 8/06*** | (2006.01) |
| ***D01F 1/10*** | (2006.01) |
| ***D01F 6/30*** | (2006.01) |
| *D02G 3/02* | (2006.01) |

(52) U.S. Cl.

CPC ..... *D01F 8/06* (2013.01); *Y10T 428/2929* (2015.01); *D01F 1/10* (2013.01); *D01F 6/30* (2013.01); *D04H 3/007* (2013.01)

(58) Field of Classification Search

CPC ..... D01F 8/00; D01F 8/06; D01F 1/00; C08L 23/14–23/142

USPC ..... 442/171, 290, 398, 164, 170, 327, 361, 442/364; 428/357, 364, 373; 604/358, 365, 604/366

See application file for complete search history.

(56) References Cited

U.S. PATENT DOCUMENTS

| | | | | | |
|---|---|---|---|---|---|
| 4,207,421 | A | * | 6/1980 | Scardera et al. | 568/625 |
| 5,456,982 | A | | 10/1995 | Hansen et al. | |
| 5,571,619 | A | * | 11/1996 | McAlpin et al. | 428/364 |
| 5,804,625 | A | | 9/1998 | Temperante et al. | |
| 6,146,757 | A | | 11/2000 | Mor et al. | |
| 6,534,174 | B1 | * | 3/2003 | Ouellette et al. | 428/360 |
| 2002/0169429 | A1 | | 11/2002 | Li et al. | |
| 2004/0241216 | A1 | | 12/2004 | Klun et al. | |
| 2005/0130539 | A1 | * | 6/2005 | Allen et al. | 442/364 |
| 2005/0159067 | A1 | | 7/2005 | Kunimoto et al. | |
| 2006/0052022 | A1 | * | 3/2006 | Suzuki et al. | 442/328 |

FOREIGN PATENT DOCUMENTS

| | | | | |
|---|---|---|---|---|
| JP | 63-211350 | A | | 9/1988 |
| JP | 2-221448 | A | | 9/1990 |
| JP | 3-504144 | A | | 9/1991 |
| JP | 5-33214 | A | | 2/1993 |
| JP | 7-252759 | A | | 10/1995 |
| JP | 2001-81626 | A | | 3/2001 |
| JP | 2002105828 | A | * | 4/2002 |
| JP | 2002-146630 | A | | 5/2002 |
| JP | 2003-52752 | A | | 2/2003 |
| JP | 2003-201670 | A | | 7/2003 |
| JP | 2004-523666 | A | | 8/2004 |
| JP | 2005-350795 | A | | 12/2005 |
| JP | 2007-107131 | A | | 4/2007 |
| WO | WO 2005/045114 | A1 | | 5/2005 |

OTHER PUBLICATIONS

Cassania, Giorgio, Characterization of Alcohol Ethoxylates as Alcohol Ethoxy Sulfate Derivatives by Liquid Chromatography-Mass Spectrometry, Journal of Surfactants and Detergents, vol. 7, No. 2 (Apr. 2004).*

Supplementary European Search Report dated Apr. 24, 2012, issued in corresponding European Patent Application No. 09809800.7. (5 pages).

International Search Report (PCT/ISA/210) issued on Oct. 27, 2009, by Japanese Patent Office as the International Searching Authority for International Application No. PCT/JP2009/064416.

* cited by examiner

*Primary Examiner* — Art Singh-Pandey

*Assistant Examiner* — Frank Vineis

(74) *Attorney, Agent, or Firm* — Buchanan, Ingersoll & Rooney PC

(57) ABSTRACT

It is an object of the present invention to develop a polypropylene nonwoven fabric which is excellent in both of initial hydrophilicity and long-lasting hydrophilicity, that is, which is excellent in initial hydrophilicity that the nonwoven fabric exhibits hydrophilicity in a short time after it is produced and long-lasting hydrophilicity that the nonwoven fabric recovers hydrophilicity in a short time even if it is subjected to heat treatment. The present invention provides fibers of a propylene copolymer composition which comprises 100 parts by weight of a propylene/α-olefin random copolymer having a melting point (Tm) of 125 to 155° C. and 0.5 to 5 parts by weight of a nonionic surface active agent comprising an alkylene oxide adduct of an aliphatic alcohol.

8 Claims, No Drawings

FIBERS, NONWOVEN FABRIC AND USES THEREOF

TECHNICAL FIELD

The present invention relates to fibers which are excellent in initial hydrophilicity and long-lasting hydrophilicity, a nonwoven fabric comprising the fibers, and uses of the nonwoven fabric.

BACKGROUND ART

Since polypropylene nonwoven fabrics are excellent in air permeability, flexibility and lightweight properties, they have been broadly applied to various uses. On that account, for the nonwoven fabrics, various properties have been required according to the uses, and besides, improvement in the properties has been required.

On the other hand, the polypropylene nonwoven fabrics are inherently hydrophobic, so that when they are used for top sheets of sanitary materials such as paper diapers and sanitary napkins, wipes, etc., it is essential to subject the polypropylene nonwoven fabrics to hydrophilic treatment.

As methods for imparting hydrophilicity to the polypropylene nonwoven fabrics, there have been proposed many methods, such as a method of treating a surface of a polypropylene nonwoven fabric with a treating agent containing plural nonionic surface active agents (e.g., patent literature 1: Japanese Patent Laid-Open Publication No. 107131/2007, patent literature 2: Japanese Patent Laid-Open Publication No. 52752/2003), a method of heat treating a spunbonded nonwoven fabric containing a surface active agent for at least 30 seconds (patent literature 3: Japanese Patent Laid-Open Publication No. 211350/1988), and a method of incorporating a surface active agent into sheaths of composite fibers (patent literature 4: Japanese Patent Laid-Open Publication No. 221448/1990)

The method of treating a surface of a polypropylene nonwoven fabric with surface active agents is excellent in initial hydrophilicity, but the surface active agents are apt to bleed out, and when the nonwoven fabric is repeatedly used, its hydrophilicity is liable to be lowered. In the method of incorporating a surface active agent into a polypropylene nonwoven fabric, appearance of hydrophilicity takes time, and there is a fear of poor initial hydrophilicity. In particular, a nonwoven fabric comprising a propylene homopolymer needs a long time before it exhibits hydrophilicity, and besides, when the nonwoven fabric is heat-treated in order to laminate it with another member, recovery of hydrophilicity needs several days. Therefore, in order to use the nonwoven fabric for top sheets of sanitary materials such as paper diapers and sanitary napkins, further improvement in hydrophilicity is desired.

CITATION LIST

Patent Literature

Patent document 1: Japanese Patent Laid-Open Publication No. 107131/2007

Patent document 2: Japanese Patent Laid-Open Publication No. 52752/2003

Patent document 3: Japanese Patent Laid-Open Publication No. 211350/1988

Patent document 4: Japanese Patent Laid-Open Publication No. 221448/1990

SUMMARY OF INVENTION

Technical Problem

It is an object of the present invention to develop fibers suitable for a polypropylene nonwoven fabric which is excellent in both of initial hydrophilicity and long-lasting hydrophilicity, that is, which is excellent in initial hydrophilicity that the nonwoven fabric exhibits hydrophilicity in a short time after it is produced and long-lasting hydrophilicity that the nonwoven fabric recovers hydrophilicity in a short time even if it is subjected to heat treatment, and to develop a nonwoven fabric. As a result of various studies, the present inventors have found that the object of the present invention can be attained by using a specific propylene/α-olefin random copolymer as a propylene-based polymer and adding and mixing a specific nonionic surface active agent as a surface active agent.

Solution to Problem

The present invention provides:

(1) fibers comprising a propylene copolymer composition which comprises 100 parts by weight of a propylene/α-olefin random copolymer having a melting point (Tm) of 125 to 155° C. and 0.5 to 5 parts by weight of a nonionic surface active agent comprising an alkylene oxide adduct of an aliphatic alcohol, a nonwoven fabric comprising the fibers, and uses of the nonwoven fabric; and (2) fibers which are core-sheath composite fibers whose core comprises a propylene copolymer composition comprising a propylene/α-olefin random copolymer having a melting point (Tm) of 125 to 155° C. and a nonionic surface active agent comprising an alkylene oxide adduct of an aliphatic alcohol and whose sheath comprises a propylene/α-olefin random copolymer having a melting point (Tm) of 125 to 155° C., wherein the nonionic surface active agent comprising an alkylene oxide adduct of an aliphatic alcohol is contained in an amount of 0.5 to 5 parts by weight based on 100 parts by weight of the total amount of the propylene/α-olefin random copolymer contained in the whole of the core-sheath composite fibers, a nonwoven fabric comprising the fibers, and uses of the nonwoven fabric.

Advantageous Effects of Invention

As for the fibers of the present invention and the nonwoven fabric comprising the fibers, the time to exhibit hydrophilicity after the production of them is not longer than 3 hours and is extremely short, and besides, even after they are subjected to heat treatment at 80° C. for 2 hours, the hydrophilicity is immediately recovered, and thus the initial hydrophilicity and the long-lasting hydrophilicity are both excellent.

Moreover, in addition to the above characteristics, the core-sheath composite fibers of the present invention and the nonwoven fabric comprising the fibers have characteristics that evaporation of the nonionic surface active agent from the surfaces of the molten resin fibers extruded in the production of the core-sheath composite fibers is suppressed and less fumes are generated, in terms of environmental sanitation in the production process.

DESCRIPTION OF EMBODIMENTS

Propylene/α-Olefin Random Copolymer

The propylene/α-olefin random copolymer to form the fibers of the present invention and the nonwoven fabric comprising the fibers is a copolymer, preferably a random copolymer, of propylene and a small amount of one or more α-olefins having 2 or more carbon atoms, preferably 2 to 8 carbon atoms, such as ethylene, 1-butene, 1-pentene, 1-hexene, 1-octene and 4-methyl-1-pentene, and has a melting point (Tm) of 125 to 155° C., preferably a melting point (Tm) of 130 to 147° C. The content of the α-olefin in the propylene/α-olefin random copolymer is not specifically restricted as long as the melting point (Tm) is in the above range, but in usual, the content thereof is in the range of 1 to 10% by mol.

The propylene/α-olefin random copolymer according to the present invention has usually a melt flow rate (MFR) (ASTM D1238, 230° C., load: 2160 g) of 20 to 100 g/10 min, preferably a melt flow rate (MFR) (ASTM D1238, 230° C., load: 2160 g) of 40, to 80 g/10 min. A propylene/α-olefin random copolymer having MFR of less than 20 g/10 min has high melt viscosity and is liable to have poor spinning properties. On the other hand, in the case of a propylene/α-olefin random copolymer having MFR of more than 100 g/10 min, the resulting fibers and the nonwoven fabric comprising the fibers are liable to have poor tensile strength and the like.

In the case of a propylene polymer having a melting point (Tm) of higher than 155° C., the resulting fibers and the nonwoven fabric comprising the fibers are poor in initial hydrophilicity and long-lasting hydrophilicity even if a nonionic surface active agent is added to the polymer. On the other hand, if a nonionic surface active agent is added to a propylene copolymer having a melting point (Tm) of lower than 125° C., the resulting fibers and the nonwoven fabric comprising the fibers are poor in molding processability and mechanical strength though they are excellent in initial hydrophilicity and long-lasting hydrophilicity.

The melting point (Tm) of the propylene/α-olefin random copolymer according to the present invention is determined in the following manner. Using a differential scanning calorimeter (DSC), the copolymer is heated up to a temperature higher by about 50° C. than the temperature at which a maximum value of a melting endothermic curve obtained by heating at a heating rate of 10° C./min is given, then held at this temperature for 10 minutes, thereafter cooled down to 30° C. at a cooling rate of 10° C./min and heated again up to a given temperature at a heating rate of 10° C./min to measure a melting curve. From the melting curve, a temperature (Tp) at which an extreme value of a melting endothermic curve is given is determined in accordance with ASTM D3418, and an endothermic peak of this peak temperature is taken as a melting point (Tm).

To the propylene/α-olefin random copolymer according to the present invention, additives usually used, such as antioxidant, weathering stabilizer, light stabilizer, anti-blocking agent, lubricant, nucleating agent and pigment, and other polymers, such as a propylene homopolymer and an ethylene-based polymer, may be added when needed, within limits not detrimental to the object of the present invention.

Nonionic Surface Active Agent

The nonionic surface active agent according to the present invention is an alkylene oxide adduct of an aliphatic alcohol, and by adding the nonionic surface active agent to the propylene/α-olefin random copolymer, initial hydrophilicity and long-lasting hydrophilicity of the resulting fibers are improved. The alkylene oxide adduct of an aliphatic alcohol according to the present invention comprises an alkylene oxide adduct of an aliphatic alcohol having 10 to 40 carbon atoms, preferably 12 to 40 carbon atoms, more preferably 16 to 22 carbon atoms.

An alkylene oxide adduct of an aliphatic alcohol having 9 or less carbon atoms has poor compatibility with the propylene/α-olefin random copolymer, and an alkylene oxide adduct of an aliphatic alcohol having 41 or more carbon atoms exhibits less hydrophilicity. In either case, initial hydrophilicity and the long-lasting hydrophilicity of the resulting fibers and the nonwoven fabric comprising the fibers are liable not to be improved.

Examples of the nonionic surface active agents according to the present invention include ethylene oxide adducts of aliphatic alcohols such as octadecanol, eicosanol, heneicosanol, tetracosanol, pentacosanol, hexacosanol, heptacosanol, octacosanol, triacontanol and tetracontanol, and propylene oxide adducts of the aliphatic alcohols. In usual, such a nonionic surface active agent is also called an AE type nonionic surface active agent.

To the nonionic surface active agent according to the present invention, other nonionic surface active agents, such as alkylene oxides of fatty acids, fatty acid alkanolamides and alkylene oxide adducts of fatty acid amides, may be added when needed, within limits not detrimental to the object of the present invention.

Propylene Copolymer Composition

The propylene copolymer composition to form the fibers of the present invention and the nonwoven fabric comprising the fibers is a composition comprising 100 parts by weight of the propylene/α-olefin random copolymer and 0.5 to 5 parts by weight, preferably 1 to 3 parts by weight, of the nonionic surface active agent.

If the amount of the nonionic surface active agent is less than 0.5 part by weight, the hydrophilicity is poor. The upper limit of the amount of the nonionic surface active agent is not specifically restricted, but if the amount thereof exceeds 5 parts by weight, the hydrophilicity becomes saturated, and besides, the amount of the surface active agent bleeding out on the surfaces of the resulting fibers and the nonwoven fabric comprising the fibers is increased, resulting in lowering of molding processability.

In the case where the propylene copolymer composition according to the present invention is prepared, it is preferable to form a masterbatch of the nonionic surface active agent in the form of pellets, which contains the nonionic surface active agent in a high concentration of more than 5% by weight, e.g., 10 to 70% by weight, because addition of the nonionic surface active agent and mixing of the nonionic surface active agent with the propylene/α-olefin random copolymer become easy in the production of the fibers and the nonwoven fabric. A propylene-based polymer used for forming the masterbatch of the nonionic surface active agent is not limited to the aforesaid propylene/α-olefin random copolymer, and a homopolymer of propylene or a propylene/α-olefin random copolymer having a melting point (Tm) out of the above range may be used. MFR of the propylene-based polymer can be properly selected according to the desired fibers and the desired nonwoven fabric comprising the fibers.

To the propylene copolymer composition according to the present invention, additives usually used, such as antioxidant, weathering stabilizer, light stabilizer, anti-blocking agent, lubricant, nucleating agent and pigment, and other polymers, such as a propylene homopolymer and an ethylene-based polymer, may be added when needed, within limits not detrimental to the object of the present invention.

Fibers and Nonwoven Fabric

The fibers of the present invention and the nonwoven fabric comprising the fibers are fibers of the propylene copolymer composition comprising the propylene/α-olefin random copolymer and the nonionic surface active agent, and a nonwoven fabric comprising the fibers, respectively.

Other embodiments of the fibers of the present invention and the nonwoven fabric comprising the fibers are core-sheath composite fibers whose core comprises the propylene copolymer composition comprising the propylene/α-olefin random copolymer and the nonionic surface active agent and whose sheath comprises the propylene/α-olefin random copolymer, and a nonwoven fabric comprising the composite fibers, respectively. In the core-sheath composite fibers of the present invention, the core/sheath weight ratio is usually in the range of 10/90 to 50/50. If the proportion of the core comprising the propylene copolymer composition containing the non-ionic surface active agent is less than 10, the time to exhibit hydrophilicity after the production is liable to be prolonged. In the core-sheath composite fibers of the present invention, the core may be a concentric core or an eccentric core as long as the sheath containing no nonionic surface active agent covers most of the fiber surface, but in order to suppress generation of fumes due to evaporation of the non-ionic surface active agent in the production process, a concentric core is preferable.

When the core-sheath composite fibers are used as the fibers of the present invention or used for the nonwoven fabric comprising the fibers, the nonionic surface active agent is contained in an amount of 0.5 to 5 parts by weight, preferably 1 to 3 parts by weight, based on 100 parts by weight of the propylene/α-olefin random copolymer contained in the whole of the core-sheath composite fibers. Therefore, the amount of the nonionic surface active agent contained in the composition which comprises the propylene/α-olefin random copolymer and the nonionic surface active agent and forms the core becomes larger than the amount of the aforesaid range according to the core/sheath weight ratio (10/90 to 50/50) of the core-sheath composite fibers.

The fibers of the present invention have usually a fineness of 0.5 to 5 deniers, preferably a fineness of 0.5 to 3 deniers. Although the fibers of the present invention may be short fibers, they are preferably long fibers because falling out of the fibers from the resulting nonwoven fabric or the like does not occur.

The nonwoven fabric of the present invention has usually Basis Weight (METSUKE) of 3 to 100 g/m$^2$, preferably Basis Weight (METSUKE) of 7 to 60 g/m$^2$. The nonwoven fabric of the present invention is preferably a long-fiber nonwoven fabric because falling of the fibers from the nonwoven fabric or the like does not occur.

The nonwoven fabric of the present invention may have been entangled according to the use application by publicly known various entangling methods, such as methods using needle punch, water jet, ultrasonic waves and the like, and methods of partially fusion bonding by heat embossing with an embossing roll or by using hot air through system. These entangling methods may be used singly or in combination of plural entangling methods.

When fusion bonding is carried out by heat embossing, the embossed area ratio is usually in the range of 5 to 30%, preferably in the range of 5 to 20%. Examples of shapes of embossed patterns include circle, ellipse, oval, square, rhombus, rectangle, quadrangle, and continuous shapes formed by using these shapes as basic shapes.

The nonwoven fabric of the present invention may have been stretched to 1 to 1.3 times, preferably 1.3 to about 2 times, in the machine direction or the cross direction by gear stretching. By carrying out gear stretching, periodical waves can be formed in the nonwoven fabric. Moreover, since the thickness of the nonwoven fabric can be increased, spot absorption capacity for urine or the like can be increased.

The nonwoven fabric of the present invention may be used alone or may be used after it is laminated with another layer, according to various uses.

Another layer laminated with the nonwoven fabric of the present invention is, for example, a layer of a knitted fabric, a woven fabric, a nonwoven fabric or a film. For laminating (combining) the nonwoven fabric of the present invention with another layer, publicly known various methods, e.g., fusion bonding methods such as heat embossing and ultrasonic fusion bonding, mechanical entangling methods such as methods using needle punch and water jet, methods using adhesives such as hot melt adhesives and urethane-based adhesives, and extrusion laminating method, can be adopted. The nonwoven fabric of the present invention recovers hydrophilicity in a short time even after it is subjected to a contact step with a high-temperature material, such as a contact step with a hot melt adhesive or a step of extrusion laminating, so that the nonwoven fabric of the present invention is highly convenient from the viewpoint of quality control of products.

Examples of the nonwoven fabrics laminated with the nonwoven fabric of the present invention include publicly known various nonwoven fabrics, such as other spunbonded nonwoven fabrics, meltblown nonwoven fabrics, wet laid type nonwoven fabrics, dry laid type nonwoven fabrics, dry laid type pulp nonwoven fabrics, flash spun nonwoven fabrics and open-fiber nonwoven fabrics.

Examples of materials to constitute the nonwoven fabrics include publicly known various thermoplastic resins. For example, there can be mentioned polyolefins which are homopolymers or copolymers of α-olefins (e.g., ethylene, propylene, 1-butene, 1-hexcene, 4-methyl-1-pentene and 1-octene), such as high-pressure low-density polyethylene, linear low-density polyethylene (so-called LLDPE), high-density polyethylene, polypropylene, a polypropylene random copolymer, poly-1-butene, poly-4-methyl-1-pentene, an ethylene/propylene random copolymer, an ethylene/1-butene random copolymer and a propylene/1-butene random copolymer, polyesters (polyethylene terephthalate, polybutylene terephthalate, polyethylene naphthalate, etc.), polyamides (nylon-6, nylon-66, polymetaxylene adipamide, etc.), polyvinyl chloride, polyimide, an ethylene/vinyl acetate copolymer, polyacrylonitrile, polycarbonate, polystyrene, ionomers, thermoplastic polyurethane, and mixtures thereof. Of these, preferable are high-pressure low-density polyethylene, linear low-density polyethylene (so-called LLDPE), high-density polyethylene, polypropylene, a polypropylene random copolymer, polyethylene terephthalate, polyamides, etc.

When a nonwoven fabric composed of crimped fibers is used as another spunbonded nonwoven fabric laminated with the nonwoven fabric of the present invention, the resulting laminate is excellent in flexibility, bulkiness and feel. When a nonwoven fabric obtained by stretching a nonwoven fabric composed of mixed fibers of thermoplastic resin long fibers and thermoplastic elastomer long fibers is used, the resulting laminate has excellent stretch properties in addition to the above characteristics.

In the case where the nonwoven fabric of the present invention is used for a top sheet, a second sheet or a sheet (core wrap) for wrapping an absorbent for absorbing articles such as disposable diapers, the nonwoven fabric preferably has a fineness of 0.5 to 3 deniers and Basis Weight (METSUKE) of 7 to 30 g/m$^2$.

In the case where the nonwoven fabric of the present invention is used for a sheet for wrapping an absorbent (core wrap) for absorbing articles, the nonwoven fabric may be used after it is laminated with the aforesaid meltblown nonwoven fabric.

The film laminated with the nonwoven fabric of the present invention is preferably an air-permeable (moisture-permeable) film which makes the best use of hydrophilicity that is a feature of the nonwoven fabric of the present invention. Examples of the air-permeable films include publicly known various air-permeable films, e.g., films having moisture permeability and made from thermoplastic elastomers, such as polyurethane-based elastomers, polyester-based elastomers and polyamide-based elastomers, and porous films obtained by stretching films made from thermoplastic resins containing inorganic or organic fine particles and thereby making the films porous. As the thermoplastic resins used for the porous films, polyolefins, such as high-pressure low-density polyethylene, linear low-density polyethylene (so-called LLDPE), high-density polyethylene, polypropylene, a polypropylene random copolymer and compositions thereof, are preferable.

Process for Producing Nonwoven Fabric

When short fibers are used as raw materials of the nonwoven fabric, the nonwoven fabric can be produced by publicly known various production processes, such as wet laid process and dry laid process (carding).

Process for Producing Long-Fiber Nonwoven Fabric

Although the long-fiber nonwoven fabric of the present invention can be produced by publicly known various processes for producing nonwoven fabrics, a production process by spunbond method is preferable because of excellent productivity.

The long-fiber nonwoven fabric of the present invention is produced by spunbond method in the following manner. In the case where a spunbonded nonwoven fabric composed of single fibers of the propylene copolymer composition is produced, one extruder is used. In the case where a spunbonded nonwoven fabric composed of core-sheath composite long fibers is produced, the propylene copolymer composition which comprises the propylene/α-olefin random copolymer and the nonionic surface active agent and forms a core and the propylene/α-olefin random copolymer which forms a sheath are melted at 180 to 250° C., preferably melted at 190 to 230° C., using separate extruders, and discharged from a spinneret having a (composite) spinning nozzle and having been preset at 180 to 250° C., preferably at 190 to 230° C., at a single hole discharge rate of 0.4 to 1.5 g/min, preferably at a single hole discharge rate of 0.5 to 0.8 g/min, to spin out (composite) fibers. The (composite) fibers thus spun out are cooled with cooling air at 10 to 40° C., preferably at 20 to 30° C., and thinned by drawing with high-speed air at a rate of 2000 to 7000 m/min, preferably at a rate of 3000 to 6000 m/min, to allow the fibers to have a given fineness. The thus treated (composite) fibers are collected on a collecting belt to accumulate them in a given thickness (Basis Weight (METSUKE)) and then entangled by an entangling method, such as a method using needle punch, water jet, ultrasonic waves or the like, or a method of partially fusion bonding by heat embossing with an embossing roll or by using hot air through system, whereby the spunbonded nonwoven fabric can be produced.

The resulting nonwoven fabric may be stretched to 1.1 to 3 times, preferably 1.3 to about 2 times, in the machine direction or the cross direction by gear stretching, specifically by the method described in Japanese Patent Laid-Open Publication No. 73967/2003, according to the use application. By carrying out gear stretching, periodical waves can be formed in the nonwoven fabric. Moreover, since the thickness of the nonwoven fabric can be increased, spot absorption capacity for urine or the like can be increased.

When gear stretching is carried out, the temperature is usually in the range of 10 to 100° C., preferably not lower than 20° C. but lower than 80° C., and in the stretching, heat is sometimes generated, so that stretching may be carried out with cooling the gear, when needed.

Absorbing Articles

The absorbing articles of the present invention are absorbing articles obtained by using the nonwoven fabric, preferably the long-fiber nonwoven fabric, for a top sheet and/or a second sheet, or a sheet for wrapping an absorbent (core wrap). The absorbing articles of the present invention include disposable diapers, pants and sanitary products.

Especially when the nonwoven fabric of the present invention is used for a top sheet, a second sheet or a sheet (core wrap) for wrapping an absorbent for a disposable diaper, the amount of the nonionic surface active agent is as follows. When the nonwoven fabric composed of the fibers of the propylene copolymer composition is used, the amount of the nonionic surface active agent is in the range of preferably of 0.7 to 3 parts by weight based on 100 parts by weight of the propylene/α-olefin random copolymer. When the nonwoven fabric composed of the core-sheath composite fibers is used, the amount of the nonionic surface active agent is in the range of preferably 0.7 to 3 parts by weight based on 100 parts by weight of the total amount of the propylene/α-olefin random copolymer contained in the whole of the core-sheath composite fibers.

EXAMPLES

The present invention is further described with reference to the following examples, but it should be construed that the present invention is in no way limited to those examples.

Property values and the like in the examples and the comparative examples were measured in the following manner. In measurement of (1) repeated absorption ratio and (2) liquid flow distance, an aqueous solution of sodium chloride (9 g/liter) having a surface tension of 70+/−2 mN/m was used as artificial urine.

Measurement of (1) repeated absorption ratio and (2) liquid flow distance was carried out under the following 2 conditions, that is, they were measured within 48 hours after the lapse of 24 hours from the production of a long-fiber nonwoven fabric (in this case, heat treatment was not carried out); and after the lapse of 24 hours or more from the production of a long-fiber nonwoven fabric, the long-fiber nonwoven fabric was heat-treated at a preset temperature of 80° C. for 2 hours and then taken out, and within 2 hours, they were measured (in this case, heat treatment was carried out).

(1) Repeated Absorption Ratio

From a long-fiber nonwoven fabric, a sample (50 mm×200 mm) was picked out. Ten filter papers of No. 2 available from ADVANTEC MFS, INC. were laid one upon another, and the sample was placed thereon horizontally. At the height of about 10 mm from the sample surface, artificial urine was gently let fall drop by drop (one drop: about 0.3 ml) at 10 points of the sample at intervals of 20 mm by the use of a dropping pipette, and the number of liquid drops absorbed by the sample within 2 seconds was measured. This operation was repeated three times at intervals of 3 minutes, then the total number of liquid drops absorbed was divided by 30, and the resulting value was taken as a repeated absorption ratio (%). As this numerical value is increased, the hydrophilicity is evaluated as more excellent.

(2) Liquid Flow Distance

From a long-fiber nonwoven fabric, a sample (50 mm×200 mm) was picked out. On a plate inclined at an angle of 45 degrees and fixed, five filter papers of No. 2 available from ADVANTEC MFS, INC. were laid one upon another, then the sample was placed thereon, and both ends of the sample in the longitudinal direction were fixed onto the plate together with the filter papers. At the height of about 10 mm from the sample surface, one drop (about 0.3 ml) of artificial urine was let fall by a dropping pipette, then the distance between the dropping point of the liquid drop and the point at which the liquid drop had been completely absorbed was measured, and the resulting distance was taken as a liquid flow distance (mm). As this numerical value is decreased, the hydrophilicity is evaluated as more excellent.

(3) Basis Weight (METSUKE) ($g/m^2$)

From a long-fiber nonwoven fabric, ten samples each having a size of 100 mm×100 mm were picked out at arbitrary positions, and the mass (g) of each sample was measured. A mean value of these samples was determined, and the resulting value was converted to a mass based on 1 $m^2$. The resulting value was taken as Basis Weight (METSUKE) ($g/m^2$).

(4) Spot Absorption Capacity

From a gear stretched long-fiber nonwoven fabric, a sample (50 mm×200 mm) was picked out. On a plate inclined at an angle of 45 degrees and fixed, holding portions each having a height of about 5 mm were provided so that both ends of the sample in the longitudinal direction could be fixed, and onto the holding portions, both ends of the sample were fixed in such a manner that the sample was floated in midair. Subsequently, at the height of about 10 mm from the sample surface, one drop (about 0.3 ml) of artificial urine was let fall by a dropping pipette, then the distance between the dropping point of the liquid drop and the point at which the liquid drop had been completely absorbed was measured, and the resulting distance was taken as a liquid diffusion distance (mm). As this numerical value is decreased, the spot absorption capacity is evaluated as more excellent.

Example 1

To 60% by weight of an ethylene oxide adduct of eicosanol ($CH_3(CH_2)_{19}$—O—$(CH_2CH_2O)_{2.5}$—H) and 40% by weight of a propylene homopolymer having MFR of 30 g/10 min, 0.05 part by weight of an antioxidant (trade name: Irgafos 168, available from Ciba Specialty Chemicals Inc.) was added, and they were melt kneaded at 230° C. and extruded to prepare a masterbatch in the form of pellets (hydrophilic agent-1).

Subsequently, to 100 parts by weight of a propylene/ethylene random copolymer (PP-1) having a melting point (Tm) of 142° C. and MFR of 60 g/10 min, 2.56 parts by weight of the hydrophilic agent-1 were added, and they were mixed to prepare a propylene copolymer composition (composition-1) for the production of a long-fiber nonwoven fabric.

Subsequently, the composition-1 was melt spun by spunbond method to obtain long fibers. At this time, white fumes derived from the hydrophilic agent-1 were generated at the exit of a spinning nozzle. The spinning was followed by heat embossing to obtain a long-fiber nonwoven fabric having Basis Weight (METSUKE) of 20 $g/m^2$. Then, using an embossing roll providing an embossed pattern shape of rhombus, an embossed area ratio of 18% and an embossed area (area based on one embossed pattern) of 0.41 $mm^2$, the nonwoven fabric was subjected to heat embossing under the conditions of embossing roll and smoothing roll temperatures of 125° C. and a linear pressure of 60 N/mm. Within 48 hours after the lapse of 24 hours from the production of the long-fiber nonwoven fabric, a repeated absorption ratio and a liquid flow distance were measured (in this case, heat treatment was not carried out). Moreover, the long-fiber nonwoven fabric after the lapse of 24 hours or more from the production was hung in the vicinity of the center of an oven (Tabai Safety Oven STS222, manufactured by Tabai Espec Corporation), heat-treated at a preset temperature of 80° C. for 2 hours and then taken out of the oven. Within 2 hours after the nonwoven fabric was taken out, the same measurement was carried out (in this case, heat treatment was carried out). The results are set forth in Table 1.

Comparative Example 1

A long-fiber nonwoven fabric was obtained in the same manner as in Example 1, except that a propylene homopolymer (PP-2) having a melting point (Tm) of 162° C. and MFR of 60 g/10 min was used instead of PP-1, and the temperatures of the embossing roll and the smoothing roll were each changed to 133° C. The resulting long-fiber nonwoven fabric was subjected to the same measurement as in Example 1. The results are set forth in Table 1.

Example 2

A long-fiber nonwoven fabric was obtained in the same manner as in Example 1, except that an ethylene oxide adduct of octadecanol ($CH_3(CH_2)_{17}$—O—$(CH_2CH_2O)_{2.5}$—H) was used instead of the ethylene oxide adduct of eicosanol (hydrophilic agent-2). The resulting long-fiber nonwoven fabric was subjected to the same measurement as in Example 1. The results are set forth in Table 1.

Comparative Example 2

A long-fiber nonwoven fabric was obtained in the same manner as in Example 2, except that a propylene homopolymer (PP-2) having a melting point (Tm) of 162° C. and MFR of 60 g/10 min was used instead of PP-1, and the temperatures of the embossing roll and the smoothing roll were each changed to 133° C. The resulting long-fiber nonwoven fabric was subjected to the same measurement as in Example 1. The results are set forth in Table 1.

Example 3

A long-fiber nonwoven fabric was obtained in the same manner as in Example 1, except that 9.1 parts by weight of the hydrophilic agent-1 were added to 100 parts by weight of PP-1 and they were mixed to prepare a propylene copolymer composition (composition-2) for the production of a long-fiber nonwoven fabric, and using a core-sheath type composite nozzle, the composition-2 for a core and PP-1 for a sheath were subjected to composite melt spinning in a core/sheath weight ratio of 30/70. At this time, white fumes were not generated at the exit of the spinning nozzle. The resulting long-fiber nonwoven fabric was subjected to the same measurement as in Example 1. The results are set forth in Table 1.

TABLE 1

| | | | Unit | Ex. 1 | Comp. Ex.1 | Ex. 2 | Comp. Ex.2 | Ex. 3 |
|---|---|---|---|---|---|---|---|---|
| Single fibers | | PP | | PP-1 | PP-2 | PP-1 | PP-2 | — |
| | | Aliphatic alcohol | | eicosanol | eicosanol | octadecanol | octadecanol | — |
| | | Amount of hydrophilic agent added | (part(s) by weight) | 2.56 | 2.56 | 2.56 | 2.56 | — |
| Composite fibers | Core | PP | | — | — | — | — | PP-1 |
| | | Aliphatic alcohol | | — | — | — | — | eicosanol |
| | | Amount of hydrophilic agent added | (part(s) by weight) | — | — | — | — | 9.1 |
| | | Composite ratio | (weight ratio) | — | — | — | — | 30 |
| | Sheath | PP | | — | — | — | — | PP-1 |
| | | Composite ratio | (weight ratio) | — | — | — | — | 70 |
| No heat treatment | Repeated absorption ratio | | (%) | 100 | 100 | 100 | 100 | 100 |
| | Liquid flow distance | | (mm) | 10 | 12 | 14 | 12 | 14 |
| After heat treatment | Repeated absorption ratio | | (%) | 100 | 68 | 100 | 35 | 100 |
| | Liquid flow distance | | (mm) | 10 | 16 | 13 | no absorption | 8 |
| Generation of white fumes in production of nonwoven fabric | | | | yes | yes | yes | yes | no |

It is clear from Table 1 that in the case of no heat treatment, the long-fiber nonwoven fabric (Comparative Example 1) obtained by adding an ethylene oxide adduct of eicosanol (hydrophilic agent-1) as a hydrophilic agent to a propylene homopolymer (PP-2) having a melting point (Tm) of 162° C. had a repeated absorption ratio of 100% and a liquid flow distance of 12 mm, and the long-fiber nonwoven fabric (Comparative Example 2) obtained by adding an ethylene oxide adduct of octadecanol (hydrophilic agent-2) as a hydrophilic agent to PP-2 had a repeated absorption ratio of 100% and a liquid flow distance of 12 mm, but after heat treatment, the repeated absorption ratios of Comparative Example 1 and Comparative Example 2 were lowered to 68% and 35%, respectively, and the liquid flow distances of Comparative Example 1 and Comparative Example 2 became 16 mm and "no absorption", respectively, that is, the distances became both longer, and the nonwoven fabrics of Comparative Example 1 and Comparative Example 2 were both poor in the long-lasting hydrophilicity.

On the other hand, it is clear that the long-fiber nonwoven fabrics (Example 1 and Example 2) using a propylene/ethylene random copolymer (PP-1) having a melting point (Tm) of 142° C. exhibited, before heat treatment, hydrophilicity of almost the same level as in the comparative examples, but also after heat treatment, a repeated absorption ratio of 100% was maintained, and besides, lowering of a liquid flow distance was not observed, that is, the nonwoven fabrics of Example 1 and Example 2 were excellent in the long-lasting hydrophilicity.

Moreover, it is clear that the long-fiber nonwoven fabric (Example 3) composed of core-sheath composite long fibers obtained by using, for the core, the composition-2 which was obtained by adding the hydrophilic agent-1 to the propylene/ethylene random copolymer (PP-1) having a melting point (Tm) of 142° C. and by using, for the sheath, PP-1 without adding a hydrophilic agent had a repeated absorption ratio of 100% and a short liquid flow distance after heat treatment, and in addition, the long-fiber nonwoven fabric of Example 3 had characteristics that generation of white fumes could be inhibited in the production of the long-fiber nonwoven fabric.

Example 4

Using a gear stretching machine having a roll diameter of 100 mm and a gear tooth pitch of 2.5 mm, the long-fiber nonwoven fabric obtained in Example 1 was stretched in the direction (cross direction) meeting at right angles to the machine direction at room temperature (about 25° C.) and a processing rate of 5 m/min while changing the degree of gearing to 1.5 mm, 2.5 mm and 3.5 mm.

As a result of measurement of a liquid diffusion distance of the gear stretched long-fiber nonwoven fabric, the long-fiber nonwoven fabric having been gear stretched with a degree of gearing of 1.5 mm had a thickness of 230 μm and a liquid diffusion distance of 70 mm; the long-fiber nonwoven fabric having been gear stretched with a degree of gearing of 2.5 mm had a thickness of 300 μm and a liquid diffusion distance of 55 mm; and the long-fiber nonwoven fabric having been gear stretched with a degree of gearing of 3.5 mm had a thickness of 280 μm and a liquid diffusion distance of 40 mm, while the long-fiber nonwoven fabric before stretching had a thickness of 100 μm and a liquid diffusion distance of 100 mm. Thus, it could be confirmed that by carrying out gear stretching, the liquid diffusion distance was shortened, that is, the spot absorption capacity was increased.

INDUSTRIAL APPLICABILITY

Since the fibers of the present invention and the nonwoven fabric comprising the fibers are excellent not only in the initial hydrophilicity but also in the long-lasting hydrophilicity, they are particularly useful for a top sheet, a second sheet or a sheet for wrapping an absorbent (core wrap) for absorbing articles such as disposable diapers and sanitary products, and they are preferably used for medical materials, sanitary materials, wrapping materials and industrial materials. Examples of uses of them include sheets, pet sheets, sheets for absorbing juice from vegetables and the like, sheets for absorbing drips from meat and fish, coffee filters, gowns, wet towels, poultice medicines, working clothes, wipers, wet tissues, gauzes, dishcloths, towels, diaper wipers, toilet cleaners, flooring cleaners, cooking stove cleaners, makeup removers and eyeglass wipers.

The invention claimed is:

1. Fibers which are core-sheath composite fibers whose core comprises a propylene copolymer composition comprising a propylene/α-olefin random copolymer having a melting point (Tm) of 125 to 155° C. and a nonionic surface active agent comprising an alkylene oxide adduct of an aliphatic alcohol that has the aliphatic alcohol moiety of 18 to 20 carbon atoms and whose sheath consists essentially of a propylene/α-olefin random copolymer having a melting point (Tm) of 125 to 155° C., wherein the core-sheath composite fibers exhibit hydrophilicity and the nonionic surface active agent comprising an alkylene oxide adduct of an aliphatic alcohol is contained in an amount of 0.5 to 5 parts by weight based on 100 parts by weight of the total amount of the propylene/α-olefin random copolymer contained in the whole of the core-sheath composite fibers.

2. The fibers as claimed in claim 1, which are long fibers.

3. A nonwoven fabric comprising the fibers as claimed in claim 1.

4. An absorbing article obtained by using the nonwoven fabric as claimed in claim 3 for a top sheet or a second sheet.

5. An absorbing article obtained by using the nonwoven fabric as claimed in claim 3 for a sheet for wrapping an absorbent.

6. A nonwoven fabric comprising the long fibers as claimed in claim claim 2.

7. An absorbing article obtained by using the nonwoven fabric as claimed in claim 6 for a top sheet or a second sheet.

8. An absorbing article obtained by using the nonwoven fabric as claimed in claim 6 for a sheet for wrapping an absorbent.

* * * * *